US009151128B2

(12) United States Patent
Le Briere et al.

(10) Patent No.: US 9,151,128 B2
(45) Date of Patent: Oct. 6, 2015

(54) DEVICE FOR INTERVENTION IN A FLUID EXPLOITATION WELL, EXPLOITATION INSTALLATION AND ASSOCIATED METHOD

(75) Inventors: Bruno Le Briere, Paris (FR); Clement Laplane, Vincennes (FR); Jean-Pierre Michel Lepine, L'etang la Ville (FR)

(73) Assignee: GEOSERVICES EQUIPEMENTS, Paris Nord II (FR)

( * ) Notice: Subject to any disclaimer, the term of this patent is extended or adjusted under 35 U.S.C. 154(b) by 1038 days.

(21) Appl. No.: 13/260,732

(22) PCT Filed: Apr. 1, 2010

(86) PCT No.: PCT/FR2010/050624

§ 371 (c)(1),
(2), (4) Date: Feb. 3, 2012

(87) PCT Pub. No.: WO2010/112779

PCT Pub. Date: Oct. 7, 2010

(65) Prior Publication Data

US 2012/0125638 A1 May 24, 2012

(30) Foreign Application Priority Data

Apr. 2, 2009 (FR) ..... 09 52130

(51) Int. Cl.
*E21B 44/06* (2006.01)
*E21B 23/14* (2006.01)
(Continued)

(52) U.S. Cl.
CPC . *E21B 23/14* (2013.01); *B66D 1/44* (2013.01); *F04B 47/04* (2013.01)

(58) Field of Classification Search
CPC ..... E21B 44/06; E21B 44/02; E21B 21/08; E21B 34/16; E21B 19/165; E21B 7/022
USPC ..... 175/27
See application file for complete search history.

(56) References Cited

U.S. PATENT DOCUMENTS 3,999,610 A * 12/1976 Sage et al. ..... 166/383
4,137,974 A 2/1979 Decker
(Continued)

FOREIGN PATENT DOCUMENTS

CN 201013359 1/2008

OTHER PUBLICATIONS

Office action for the equivalent Chinese patent application No. 201080023289.9 issued on Oct. 24, 2013.

*Primary Examiner* — David Bagnell
*Assistant Examiner* — Ronald Runyan
(74) *Attorney, Agent, or Firm* — Stephanie Chi

(57) ABSTRACT

This device comprises a cable working line bearing a lower assembly and a winch for maneuvering the line.
The hydraulic central unit (46) of the winch includes a tank (50) for storing a hydraulic control fluid, a pump (52) for driving the hydraulic fluid, connected to the tank (50) through an upstream conduit (54) and at least one hydraulic motor (56) for driving the drum (42) connected to the pump (52) through an intermediate conduit and connected to the tank (50) through a downstream conduit.
The hydraulic central unit comprises a regulator (62) for the hydraulic fluid flow rate at the outlet of the pump (52). The regulator (62) is driven according to at least one hydraulic fluid pressure depending on the load exerted on the motor (56) by the rotary drum (42), said or each pressure being directly taken on one of said conduits.

8 Claims, 6 Drawing Sheets

(51) Int. Cl.
*B66D 1/44* (2006.01)
*F04B 47/04* (2006.01)

(56) References Cited

U.S. PATENT DOCUMENTS 4,187,681 A * 2/1980 Johnson ..... 60/395
4,330,991 A * 5/1982 Budzich ..... 60/427
4,875,530 A * 10/1989 Frink et al. ..... 175/27
5,794,438 A 8/1998 Lisniansky
7,100,687 B2 9/2006 Pauley
7,475,729 B2 1/2009 Johnson
8,220,534 B2 7/2012 Millet et al.
2008/0017022 A1 1/2008 Toji et al.
2008/0271793 A1 11/2008 Schniederjan

* cited by examiner

DEVICE FOR INTERVENTION IN A FLUID EXPLOITATION WELL, EXPLOITATION INSTALLATION AND ASSOCIATED METHOD

The present invention relates to a device for intervention in a fluid exploitation well, of the type comprising:

- a lower assembly bearing at least one intervention and/or measurement tool, intended to be introduced into the well;
- a cable working line bearing the lower assembly;
- a winch for maneuvering the line, the winch comprising a rotary drum for winding up the line and a hydraulic central unit for driving the drum into rotation, the hydraulic central unit including:
- a tank for storing a hydraulic control fluid;
- a pump for driving the hydraulic fluid contained in the tank, connected to the tank through an upstream conduit;
- at least one hydraulic motor for driving the drum connected to the pump through an intermediate conduit and connected to the tank through a downstream conduit.

The invention notably applies to operations which have to be carried out in the well by means of tools attached to the lower assembly. These operations are for example the opening and closing of valves, the breaking of shear pins, the production of perforations, the setting-up and removal of tools in the well, or the fishing-out of tools blocked in the well (for example laying and withdrawing anchor mandrels).

In order to perform this type of operations, the tool is mounted on the free end of a cable working line which may notably be a smooth single-strand cable of the "piano wire" or "slick line" but also a stranded cable, a so called "braided line" or "electric line". These cables are generally in steel but may be coated or in a composite material. In order to unwind the cable working line, the use of a winch is known, which is brought to the vicinity of the well, and which is maneuvered in rotation in order to wind and unwind the cable in the well.

For this purpose, known winches generally comprise a drum on which the cable working line is wound, and a hydraulic central unit for driving the drum into rotation.

The hydraulic central unit is in most cases of the "open loop" type. This type of central unit comprises a storage tank containing a large amount of hydraulic fluid, a hydraulic conduit having two ends immersed in the tank, a pump and a motor mounted in series on the hydraulic conduit.

An adjustable bypass connects the outlet of the pump upstream from the motor to the tank.

This type of central unit operates by actuating the pump so that it permanently delivers a maximum flow of fluid and by selectively diverting a selected amount of hydraulic fluid through the bypass depending on the load and on the required speed on the motor.

Such central units are therefore very reactive in particular when a significant load has to be exerted on the cable working line, or when a high speed or high acceleration has to be obtained very rapidly. However, these central units consume a lot of energy and are not very performing when the displacement of the cable working line is slow, notably for recording logs or "logging" in the well. The design of the currently used bypasses, with a valve with directional control, is very robust since it is possible to pass from zero flow rate to maximum flow rate, within a fraction of a second. This design is however very unstable with the pressure change in the circuit induced by variations of the load, notably on the cable tension. The result of this is instability on the flow rate and therefore on the speed which may be a problem for a logging operation. From an ergonomic point of view, the use of this type of hydraulic circuit is also difficult for the operator since it requires simultaneous handling of the bypass valve and of the brake during jarring with a jar or more generally of the bypass valve and of the pressure control.

In order to overcome all these problems, closed loop hydraulic central units have also been used. This type of central unit is equipped with a hydraulic tank with reduced volume. The cylinder capacity of the pump is adjustable manually and the outlets of the pump are directly connected to the inlets of the motor.

Closed loop central units allow more accurate adjustment of the deployment speed notably at a slow speed (10 m/min is the normal speed for a logging operation), and limitation of the energy consumption since the pump is only powered according to the required speed.

However, they have the drawback of not being sufficiently reactive when a high acceleration has to be obtained rapidly upon moving upwards or downwards. Further, if several systems are simultaneously powered in the vicinity of the well, such as for example a winch and a generator, a hydraulic supply pump is required for each system, which increases maintenance costs and the complexity of the hydraulic circuit.

An object of the invention is therefore to obtain a device for intervention in a well which is very reactive, while consuming little energy and having good accuracy and stability at low speeds regardless of the load.

For this purpose, the object of the invention is a intervention device of the aforementioned type, characterized in that the hydraulic central unit comprises a regulator for the flow of hydraulic fluid delivered to said or each hydraulic motor, the regulator being driven according to at least one hydraulic fluid pressure depending on the load exerted on the motor by the rotary drum, said or each pressure being directly taken on one of said conduits.

The device according to the invention may comprise one or more of the following features, taken individually or according to any technically possible combination(s):

- the hydraulic central unit comprises an adjustable calibrated throttle, mounted on the intermediate conduit, an upstream tap and a downstream tap for taking the pressure upstream and downstream from the throttle, the regulator being servo-controlled in order to maintain the pressure difference taken between the upstream and downstream taps, substantially constant at an adjustable threshold value;
- the regulator comprises an assembly for adjusting the flow rate of the pump including a mobile member between a minimum flow rate position and a maximum flow rate position,
- the regulator comprising an assembly for servo-control of the mobile member including a control valve having a displaceable slide between a first control position for displacing the mobile member towards the maximum flow rate position and a second control position for displacing the mobile member towards the minimum flow rate position, the upstream tap and the downstream tap being hydraulically connected to the control valve in order to displace the slide between its control positions depending on the pressure difference between the upstream tap and the downstream tap;
- the adjustment assembly comprises an enclosure delimiting a chamber for receiving the mobile member, the mobile member defining in the chamber an upstream region hydraulically connected to one of said conduits and a downstream region hydraulically connected to the control valve, the slide in its first position being connected to the downstream region, in order to supply the downstream region with pressurized hydraulic fluid, and a second position hydraulically connecting the downstream region to a low pressure tank;

the device comprises a bypass tubing connecting the outlet of the pump to the tank, the regulator comprising a valve for controlling the flow circulating through the bypass tubing;

the hydraulic central unit comprises a switching valve which may be displaced between a first activation position in which the intermediate conduit is formed between the outlet of the pump and a first inlet of the motor, and the downstream conduit is formed between a second inlet of the motor and the tank, and a second activation position in which the intermediate conduit is formed between the second inlet of the motor and the outlet of the pump and the downstream conduit connects the first inlet of the motor and the tank;

the calibrated throttle is placed in the switching valve; and the hydraulic central unit comprises a hydraulically driven member, connected to the pump in parallel on the hydraulic motor.

This type of device is compatible in terms of performances with all the useful applications on the proven oil land: log recordings ("logging"), mechanical work with the standard cable, fishing-out, jar hammering, pistoning in the well. It gives the possibility, without complicating the hydraulic circuit, of associating a certain number of hydraulic accessories therewith.

The object of the invention is further an installation for exploiting fluid, characterized in that it comprises:

an exploitation well made in the ground, the well opening out at a first point located at the surface of the ground;

a well head, obturating the well at the first point; and and an intervention device as defined above, the lower assembly and the working line being introduced into the well through the well head.

The object of the invention is also a method for intervention in an exploitation well, characterized in that comprises the following steps:

mounting the lower assembly on the working line and introducing the lower assembly and the working line into the well;

actuating the hydraulic central unit in order to drive the drum into rotation, the actuation comprising:

applying the pump for driving the hydraulic motor by circulating hydraulic fluid in said conduits, and regulating the delivered flow to said or to each hydraulic motor according to at least one pressure depending on the load exerted on the motor by the drum, said or each pressure being directly taken on one of said conduits.

The invention will be better understood upon reading the description which follows, only given as an example, and made with reference to the appended drawings wherein.

Figure 1:
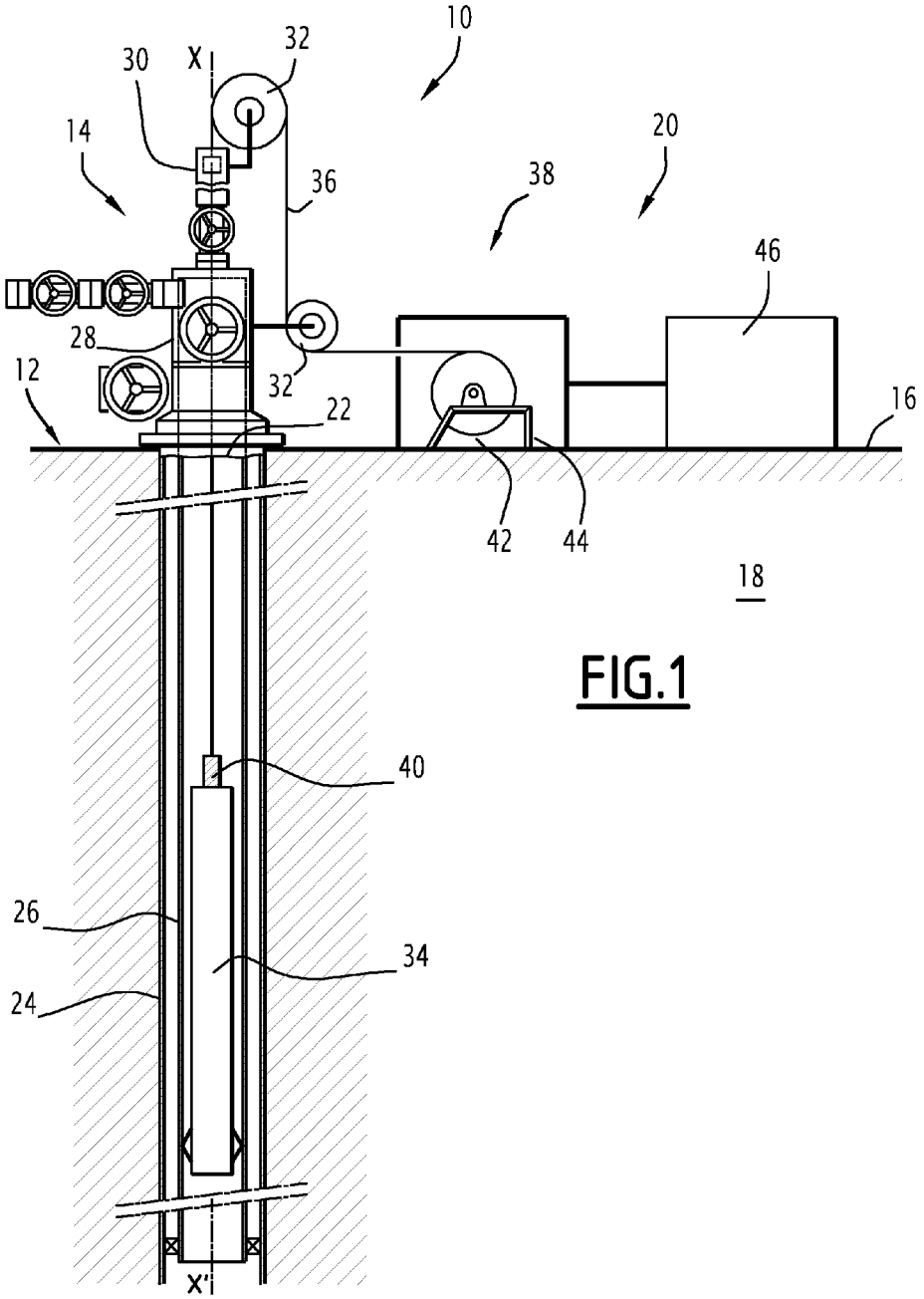
FIG. 1 is a schematic partial sectional view along a median vertical plane of a first fluid exploitation installation comprising an intervention device according to the invention.

A first fluid exploitation installation 10 according to the invention is illustrated in FIG. 1. This installation 10 comprises a fluid exploitation well 12 contained in the ground 18, a well head 14 obturating the well 12 at the surface 16 of the ground 18, and an intervention device 20 according to the invention for performing operations in the well 12.

The well 12 is made in the ground 18 in order to connect a layer of fluid to be exploited (not shown) located in depth in the ground 18 to a first point 22 located at the surface.

Conventionally the well 12 comprises an outer conduit 24 called a "casing" and an inner conduit 26 called "a production tube" for conveying the fluid from the layer up to the first point 22. The exploited fluid is for example a hydrocarbon such as petroleum or gas.

The well head 14 selectively obturates the conduits 24, 26 at the first surface point 22. It thus comprises a device 28 for obturating the well and, for introducing the intervention device 20 into the well 12, sealing means 30 and guide pulleys 32.

The intervention device 20 comprises a lower assembly 34 intended to be introduced into the conduits 24, 26 of the well 12, a cable working line 36 for deployment of the lower assembly 34 in the well 12, inserted into the well through the well head 14 and a winch 38 for maneuver the cable working line.

The lower assembly 34 is of a generally elongated shape. For example it bears tools for intervention in the well such as an anchor, a jar, an actuator, an explosive head, or further measurement tools such as sensors for measuring temperature or pressure in the well, sensors for measuring properties of the formation around the well, such as the natural radiation emitted by the formation.

In this example, the cable working line 36 is formed by a solid single-strand smooth cable, called "a piano wire", designated by the term of "slickline". This cable is made in a metal material, such as electroplated stainless steel (for example of the 316 type). This smooth cable has good resistance to pressure and adequate flexibility. Typically, this type of cable is made with a breaking strength of 300 daN to a 1,500 daN, preferably from 600 to 1,000 daN. It has a length of more than 5,000 meters generally comprised between 1,000 meters and 4,000 meters depending on the depth of the well. Certain very deep wells may attain 8,000 meters.

Alternatively, the cable is a stranded cable of the "braided line" or "electric line" type.

The cable working line 36 is unwound from the winch 38, and then passed around the return pulleys 32 before being introduced into the well through the sealing means 30. The lower assembly 34 is attached to the free end 40 of the line 36.

The winch 38 comprises a rotary drum 42 for winding up the line 38, a drum support 44 laid on the ground 18, and a hydraulic central unit 46 for actuating and controlling the rotary drum 42.

The drum 42 is rotatably mounted about a horizontal axis on the support 44. It comprises a substantially cylindrical outer surface for winding up the line 38.

The rotation of the drum 42 about its axis in a first direction winds the line 36 around the drum and displaces the lower assembly 34 towards the top of the well 12, while the rotation of the drum 42 about its axis in a second direction unwinds the line 38 out of the drum 42 and moves the lower assembly 34 towards the bottom of the well 12.

Figure 2:
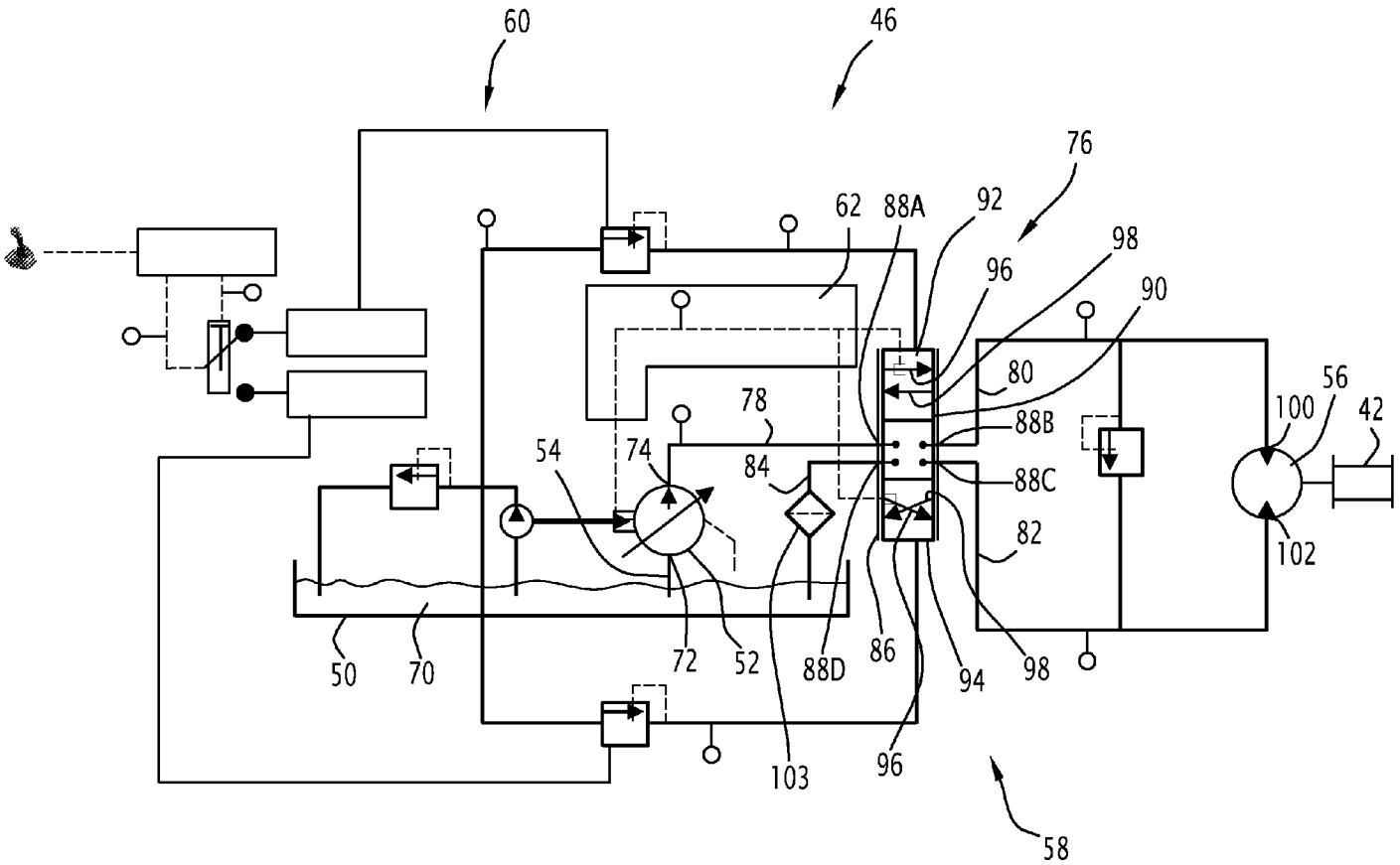
FIG. 2 is a simplified hydraulic diagram of the hydraulic central unit for driving the winch in the intervention device of FIG. 1.

As illustrated by FIG. 2, the hydraulic central unit 36 comprises a tank 50 for storing a hydraulic drive fluid, a pump 52 for displacing the hydraulic fluid, connected to the tank 50, and a motor 56 for driving into rotation the drum 42 hydraulically connected to the pump 52 and to the tank 50 through a selective distributor 58 allowing the motor 56 and the drum 42 to be driven into rotation in the first direction or in the second direction.

The central unit 46 further comprises means 60 for controlling the selective distributor 58 and, according to the invention, a regulator 62 of the hydraulic flow provided by the pump 52, controlled depending on a pressure difference of the hydraulic drive fluid, which pressure difference depends on the load exerted on the motor 56 by the rotary drum 42.

The tank 50 consists of a fluid reservoir 70 maintained at a pressure substantially equal to atmospheric pressure. The reservoir 70 contains a volume of hydraulic fluid greater than at least once the volume of fluid contained in the upstream conduit 54 and in the selective distributor 58.

The pump 52 comprises an inlet 72 into which the upstream conduit 54 opens out, and an outlet 74 connected to the distributor 58. It is for example driven by a diesel engine. The hydraulic fluid flow rate at the outlet 74 of the pump 52 is adjustable, this adjustment being carried out by means of the regulator 62 as this will be seen below.

The selective distributor 58 comprises a switching slide gate valve 76, and, connected to the slide gate valve 76, an outlet tubing 78 of a pump 52, a first tubing 80 and a second tubing 82 for connecting to the motor 56, and a tubing 84 for discharging towards the tank.

The slide gate valve 76 is for example a valve of the MV18 type from the German corporation BUCHER or a WM18 valve from LINDE.

The slide gate valve 76 comprises a valve body 86 having four inlets 88A to 88D respectively connected to the tubing 78 to 84. It further comprises a mobile slide 90 in the valve body 86 having an upper hydraulic distribution stage 92 for circulating the hydraulic fluid in the motor 56 in a first direction, and a lower hydraulic distribution stage 94 for circulating the hydraulic fluid in the motor 56 in a second direction.

Each stage 92, 94 comprises a feed segment 96 connecting the outlet tubing 78 of the pump and one of the first and second tubings 80 and 82, and a discharge segment 98 connecting the other of the first and second tubings 80,82 with the tubing 84 for connecting to the tank.

The slide 90 is displaceable in the valve body 86 between a first activation position of the upper stage 92, in which the upper stage 92 is placed facing the inlets 88A to 88D and a second activation position of the lower stage 94 in which the lower stage 94 is connected to the inlets 88A to 88D.

In the first activation position, the feed segment 96 of the upper stage 92 connects the outlet tubing 78 of the pump to the first tubing 80 in order to bring the fluid pumped by the pump through the outlet tubing 78 of the pump, the segment 96 and the first tubing 80 as far as a first inlet 100 of the motor 56 and to form an intermediate conduit between the outlet 74 of the pump and the first inlet 100 of the motor 56.

In this position, the discharge segment 98 connects the second tubing 82 to the discharge tubing 84 in order to form a downstream conduit between the second inlet 102 of the motor 56 and the tank 50.

In the first activation position, the lower stage 94 is placed away from the inlets 88A to 88D and is therefore inactive.

In the second activation position, the supply segment 96 of the lower stage 94 connects the outlet tubing 78 of the pump to the second tubing 82 in order to create the intermediate conduit between the outlet 74 of the pump and the second inlet 102 of the rotor.

Also, the discharge segment 98 connects the first tubing 80 to the discharge tubing 84 in order to create a downstream conduit extending between the first inlet 100 and the tank 50.

In the second activation position, the upper stage 92 is placed away from the inlets 88A to 88D and is therefore inactive.

Thus, the displacement of the slide 90 between its first activation position and its second activation position controls the direction of circulation of the fluid in the motor 56 and therefore the direction of rotation of the drum 42.

The discharge tubing 84 is provided with a filter 103 for the hydraulic fluid.

The control means 60 comprise means for controlling the slide 90 of the valve 76 in order to move it between its first activation position and its second activation position depending on the direction of rotation required on the drum 42.

According to the invention, the regulator 62 controls the fluid flow rate at the outlet 74 of the pump 52 at any moment during the rotation of the motor 56. This control is carried out depending on the load applied on the motor 56 by the drum 42 under the effect of the cable working line 36.

Figure 3:
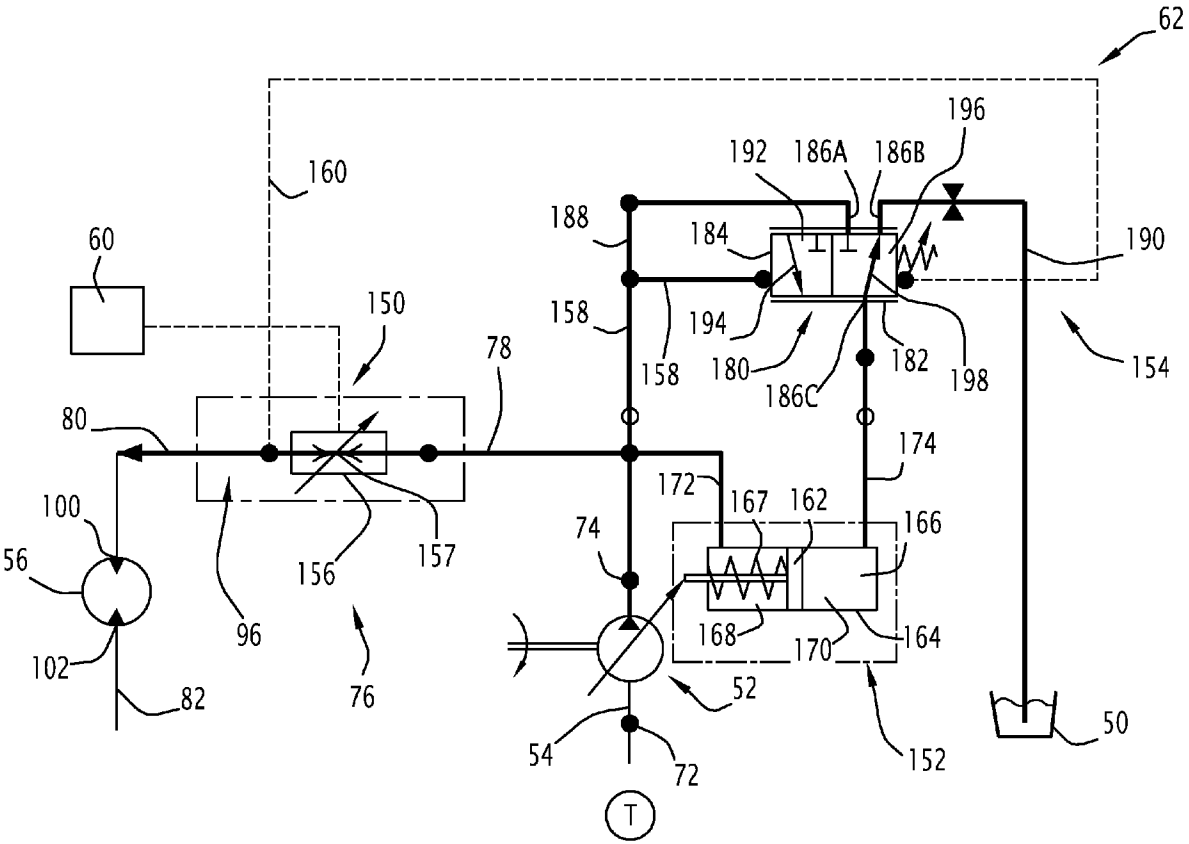
FIG. 3 is a simplified hydraulic diagram of the flow rate controller of the hydraulic central unit of FIG. 2.

For this purpose, as illustrated by FIG. 3, the regulator 62 comprises a calibrated throttle 150 for measuring the applied load, an assembly 152 for adjusting the flow rate of the pump 52, and a servo-control assembly 154 for the adjustment assembly 152 in order to servo-control the flow rate at the outlet 74 of the pump 52 while maintaining a constant pressure difference at the ends of the throttle 150.

The throttle 150 comprises a valve 157 having an orifice with a diameter adjustable by the control means 60. The diameter of the orifice is advantageously smaller than the average diameter of the conduit on which the throttle is mounted.

In this example, the valve with an adjustable orifice 157 is placed in the slide gate valve 76 of the selective distributor 58. Thus, for each stage 92 and 94, a valve with an adjustable orifice 157 is mounted in series on the hydraulic fluid supply segment 96. Consequently, a calibrated throttle 150 is mounted in series on the intermediate conduit connecting the outlet 74 of the pump 52 to an inlet 100, 102 of the motor 56 regardless of the position of the slide 90 of the valve 76.

As illustrated by FIG. 3, the throttle 150 further comprises an upstream tap 158 and a downstream tap 160 for taking the pressure upstream and downstream of the valve 157, respectively. The tappings 158 and 160 open out into the segment 96 and are hydraulically connected to the servo-control assembly 154, in order to servo-control the adjustment assembly 152 of the pump according to the pressure difference measured at the ends of the valve with an adjustable orifice 157.

The adjustment assembly 152 and the servo-control assembly 154 are for example integrated within an HPR105-02 assembly from the German corporation LINDE.

The adjustment assembly 152 comprises a piston 160 for actuating the plate of the pump 52, mounted so as to be mobile in a cylinder 164 delimiting a circulation chamber 166 of the piston 162.

The piston 162 is displaceable in the chamber between a first end position, on the right in FIG. 3, in which the outlet flow rate of the pump 52 is maximum and a second end position, on the left in FIG. 3, in which the outlet flow rate of the pump is substantially zero.

The piston 162 sealably delimits in the chamber 166, an upstream region 168 and a downstream region 170. A spring 167 is interposed between the piston 162 and the wall of the cylinder 164 in the upstream region in order to urge the piston towards the first end position.

The upstream region 168 is connected to the outlet 74 of the pump through a tap 172 for setting pressure, so that the pressure in the upstream region 168 is substantially equal to the pressure upstream from the valve with an adjustable orifice 157.

The downstream region 170 is connected to the servo-control assembly 154 through a servo-control conduit 174.

The servo-control assembly 154 comprises a slide gate regulator 180 which includes a regulator body 182 and a mobile slide 184 driven under the effect of the pressure difference received from the tappings 158, 160.

The regulator body 182 comprises three inlets, 186A to 186C. The first inlet 186A is connected to the upstream tap 158 through a fork 188 for feeding fluid to the regulator 180 at a pressure substantially equal to the pressure taken upstream from the valve 157.

The second inlet 186B is connected to the tank 50 through a discharge tubing 190 for depressurisation of the regulator.

The third inlet 186C is connected to the servo-control conduit 174 of the adjustment assembly 152.

The slide 184 comprises a first stage 192 having a segment 194 for connecting the first inlet 186A to the second inlet 186B, and a second stage 196 having a segment 198 for connecting the second inlet 186B to the third inlet 186C.

The slide 184 is mobile in the valve body between a first control position for activating the first stage 192, in which the servo-control conduit 174 is connected to the fork 188 for feeding this conduit 174 and the downstream region 170 with pressurized fluid, and a second control position for activating the second stage 196, in which the servo-control conduit 174 is connected to the discharge tubing 190 by the segment 198 for discharging pressurized fluid contained in the downstream region 170 towards the tank 50.

The displacement of the slide 184 between its control positions results from the application of the pressure in the upstream tap 158 on a surface of the slide 184 and from the application of the pressure present in the downstream tap 160 on a surface opposite to the slide 184. This displacement is therefore controlled hydraulically.

The operation of the intervention device 20 according to the invention during an intervention within the first fluid exploitation installation 10 will now be described.

Initially, the winch 38 is brought to the vicinity of the well head 14. The cable working line 36 is partly unwound so as to have it pass in the return pulleys 32, and then through the sealing means 30. The lower assembly 34, bearing at least an intervention tool, is introduced through an airlock provided in the sealing means 30. The tool 34 is then attached to the free end 40 of the cable working lines 36.

Next, the operator of the intervention device 20 actuates the winch 38 in order to unwind the cable working line 36 out of the drum 42 and to have the tool 34 move downwards into the well.

For this purpose, he/she acts on the control means 60 in order to control the drum 42 rotation in a first direction with view to unwinding the line 36.

Thus, the control means 60 control the switching slide gate valve 76 for displacing the slide 90 into its first activation position and to place the upper stage 92 facing the inlets 88A to 88D.

In this configuration, a closed hydraulic circuit, on which are mounted in series the pump 52 and the motor 56, is formed between the upstream conduit, the pump 52, the pump outlet tubing 78, the feed segment 96 and the first tubing 80 for connecting to the motor as far as the first inlet 100 of the motor 56. The hydraulic fluid pumped by the pump 52 then circulates in the motor 56 between the first inlet 100 and the second inlet 102 and is discharged towards the tank 50 through the second tubing 82, the discharge segment 98 and the tubing 84 for connecting to the tank passing through the filter 103.

The fluid flow rate at the outlet 74 of the pump is automatically controlled by the regulator 62 depending on the diameter of the orifice of the valve 157, for this purpose, when the load strongly increases on the motor 56, the pressure difference on the terminals of the adjustable orifice valve 157 decreases and is sensed by the tappings 158, 160. This pressure difference is hydraulically transmitted to the control assembly 180 for controlling displacement of the slide 184 from its position for activating the first stage 192 towards its position for activating the second stage 196.

When this difference is greater than an adjustable threshold value, for example 20 bars, the flow rate of the pump 52 has to be increased in order to maintain a constant pressure difference between the taps 158, 160 at the ends of the adjustable orifice valve 157. When the threshold value is exceeded, the hydraulic fluid present in the taps 158, 160 displace the slide 182 towards its activation position of the second stage.

The servo-control conduit 174 is then connected to the tank 50 through the segment 198. The pressurized fluid present in the downstream region 170 is then discharged towards the tank 50, through the discharge tubing 190, which reduces the volume of the downstream region 170. The piston 162 is thereby displaced towards the first end position, thereby increasing the fluid flow rate at the outlet of the pump 52.

On the contrary, when the pressure difference at the terminals of the adjustable orifice valve 157 increases beyond the threshold value, the slide 184 is displaced to the position for activating the first stage 192, which causes connection of the fork 188 to the servo-control conduit 174. The pressurized fluid present in the fork 188 is then introduced into the downstream region 170, causing the displacement of the piston 162 towards its second end position and reduction in the output flow rate of the pump 52.

Additionally, by adjusting the size of the calibrated orifice of the valve 157 with the control means 60 it is possible to adjust the controlled fluid flow rate circulating through the motor 56 in order to increase or decrease the speed of rotation of the drum 42.

In order to move the line 30 up by winding it up around the drum 42, the operator actuates the control means 60 for displacing the slide 90 of the valve 76 towards its second activation position, in which the lower stage 94 is connected to the inlets 88A-88D.

In this configuration, the intermediate conduit connecting the outlet 74 of the pump to the motor 56 is formed through the outlet tubing 78 of the pump, and the second tubing 82 for connection to the motor, as far as the second inlet 102. The downstream conduit for discharging the fluid is formed between the first inlet of the motor 100 and the tank 50 through the first tubing 80 and the tubing 84 for discharging towards the tank.

The combination of a significant volume of available hydraulic fluid and of a very reactive regulation by the regulator 62 allows a very rapid increase in the fluid flow rate at the outlet 74 of the pump 52 and thereby sufficient hydraulic power is made available for driving into rotation the motor 56 at great speed or when the load strongly increases on the drum 42.

Moreover, when the motor 56 operates at slow speed, the control provided according to the load applied on the terminals of the throttle 156 by the regulator 62 provides accurate operation, independent of the load and controlled displacement of the winch 38 and therefore of the cable working line 36.

The intervention device 20 according to the invention, as for the winches in open circuit, has high hydraulic power for very rapidly increasing the speed or the load applied on the cable working line 36. It also gives the possibility of benefiting from accurate control of the hydraulic fluid flow rate passing through the motor 56 similar to that of a winch in a closed circuit when great accuracy on the control speed is required.

By means of the invention which has just been described, it is therefore possible to have an intervention device in a well comprising a lower assembly intended to be introduced into the well by means of a cable working line and a winch for maneuvering the line which operates in an accurate and stable way, with reduced consumption of energy.

The structure of the hydraulic circuit within the central unit may also easily be modulated in order to add auxiliary members for generating energy or other motors in parallel on the motor for driving the winch.

Thus, in a second device 220 according to the invention, a second motor, an electricity generator or a piston is mounted in parallel on the motor.

Figure 4:
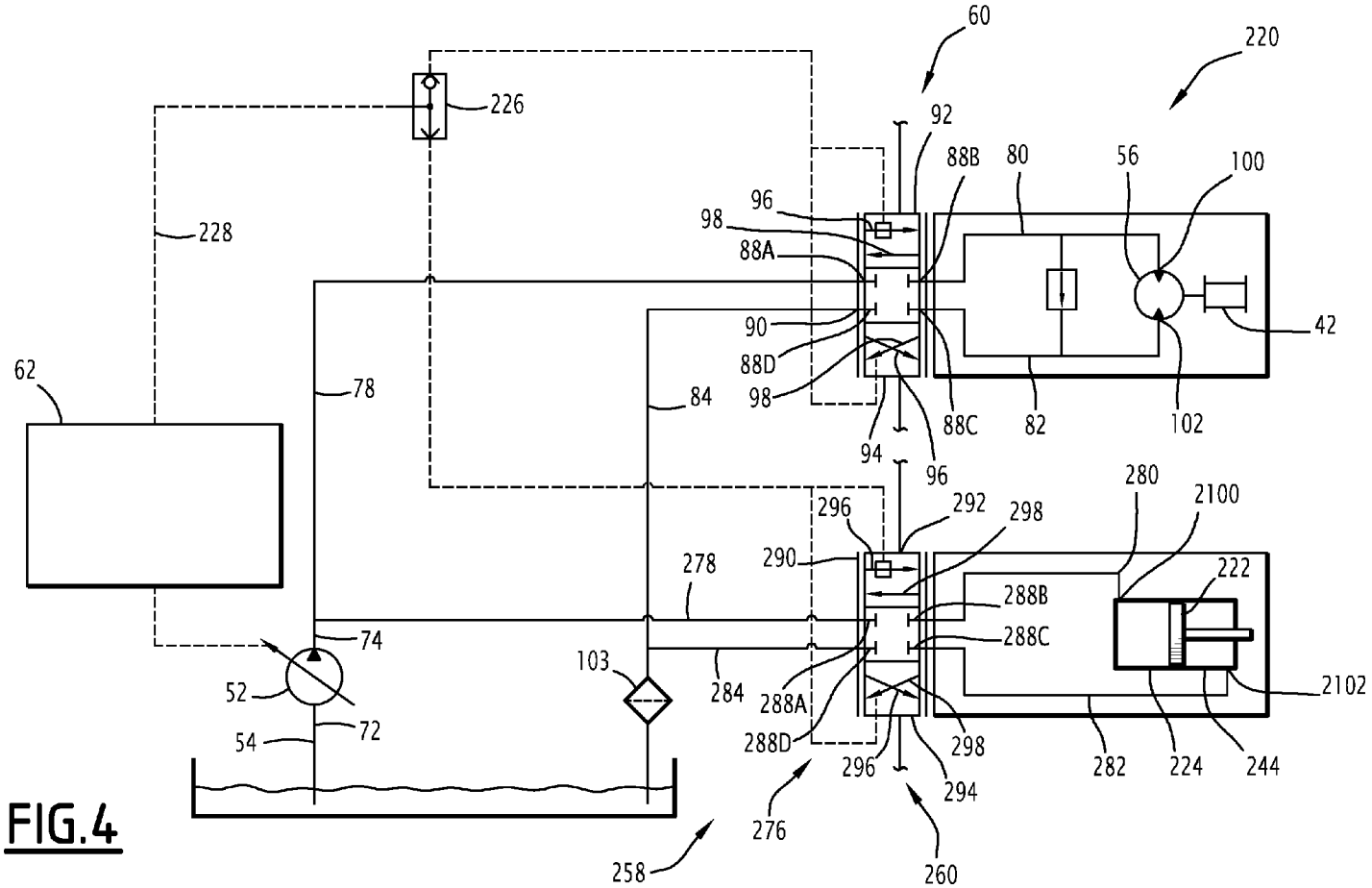
FIG. 4 is a view analogous to FIG. 2 of a second intervention device according to the invention.
Figure 5:
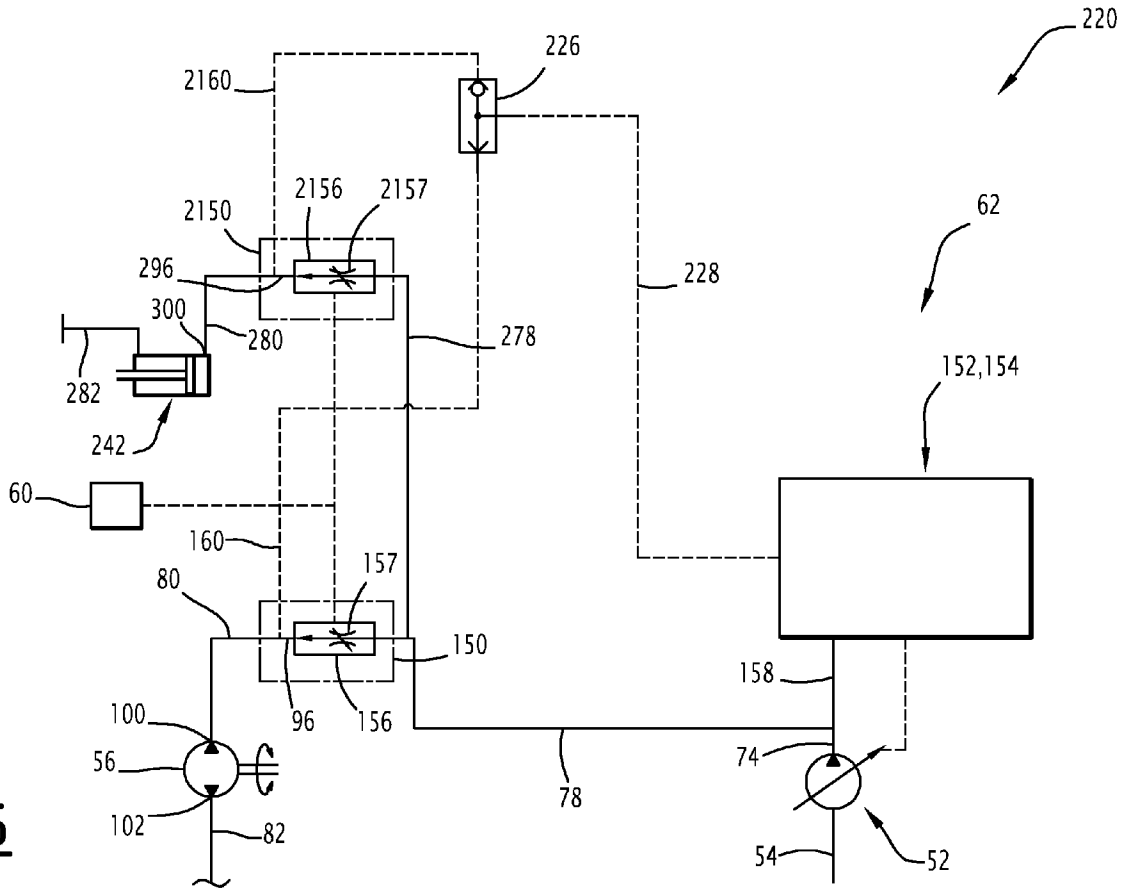
FIG. 5 is a view analogous to FIG. 3 of the second intervention device according to the invention.

In the example illustrated in FIGS. 4 and 5, the second device 220 comprises a piston 222 mounted so as to be mobile in a cylinder 224.

The second device 220 also comprises a selective distributor 258 for controlling the piston which includes a switching slide gate valve 276.

The selective distribution 258 comprises, connected to the slide gate valve 276, an auxiliary pump outlet tubing 278 tapped on the outlet tubing 78, a first auxiliary tubing 280 and a second auxiliary tubing 282 for connecting to the cylinder 224 and an auxiliary tubing 284 for connecting to the tank 50, tapped on the tubing 84 for connecting to the tank upstream from the filter 103.

The additional slide gate valve 276 is of a structure identical with that of the slide gate valve 76. Thus, the components of this valve 276 are illustrated identically in FIG. 4 with the components of the valve 76, with references beginning by the number 2. This slide gate valve 276 will therefore not be described in detail.

The first auxiliary tubing 280 connects the inlet 288B of the valve 276 to a first inlet 2100 of the cylinder 224 located on one side of the piston 222. The second auxiliary tubing 282 connects the inlet 288C of the valve 276 to a second inlet 2102 of the cylinder 244 located on another side of the piston 222 with respect to the first inlet 2100.

Unlike the first device 10, the control means 60 further comprise means for controlling the slide 290 of the slide gate valve 276 for displacing it between a first position for actuating the piston and a second position for actuating the piston, depending on the required direction of displacement on the piston 222.

An auxiliary calibrated throttle 2150 for measuring the applied load on the piston 222, is mounted in parallel on the calibrated throttle 150. This calibrated throttle 2150 is located inside the slide gate valve 276 on the feed segment 296.

This auxiliary calibrated throttle 2150 has a structure analogous to that of the calibrated throttle 150 and will not be described in detail below.

The throttle 150 and the auxiliary throttle 2150 are hydraulically connected to the servo-control assembly 154 via upstream tappings 160, 2160 which are connected together through a directional valve 226.

The directional valve 226 is connected through a common upstream tapping 228 to the servo-control assembly 254.

As in the first device 20, the downstream tapping 158 remains tapped on the pump outlet tubing 78, between the outlet 74 of the pump 52 and the tapping of the auxiliary pump outlet tubing 278.

The directional valve 226 has a logic circuit for selecting at each instant between the upstream tapping 2160 and the auxiliary upstream tapping 160, the one which has the highest pressure, and for transmitting this pressure to the servo-control assembly 154 via the common upstream tapping 228.

The adjustment assembly 152 and the servo-control assembly 154 are moreover identical with those illustrated in FIG. 3.

The operation of the second device 220 according to the invention for the remainder is analogous to that of the first device 20.

Figure 6:
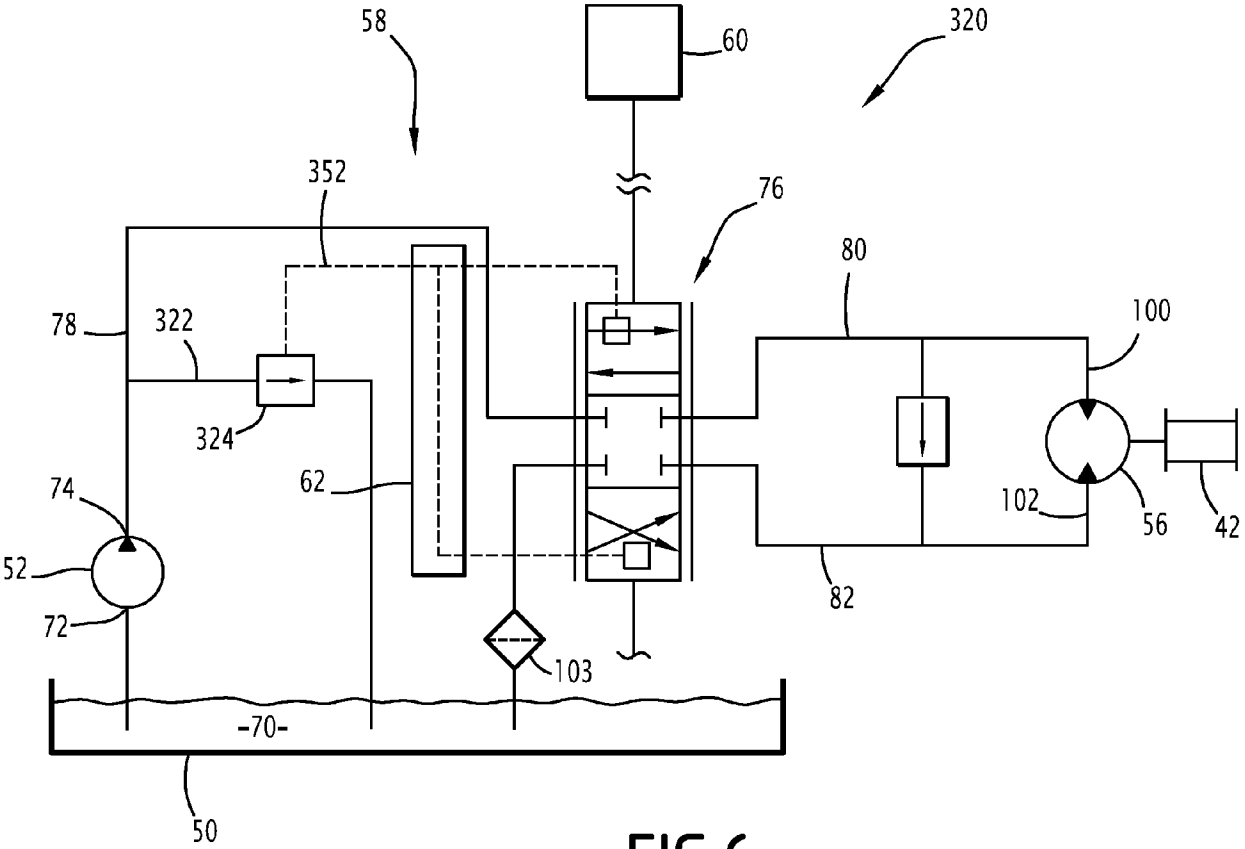
FIG. 6 is a view analogous to FIG. 2 of a third intervention device according to the invention.

A third device 320 according to the invention is illustrated in FIG. 6. Unlike the first device 20, the pump 52 delivers a constant output flow rate.

A bypass tubing 322, provided with a control valve 324 delivering an adjustable flow, is tapped on the pump outlet tubing 78. The bypass tubing 322 opens out into the tank 50 and is capable of diverting an adjustable fraction comprised between 0% and 100% of the output flow from the pump up to the tank 50, and therefore to deliver to the motor an adjustable flow comprised between 100% and 0% of the constant flow from the pump.

Unlike the first device 20, the regulator 62 of the third device 320 includes an assembly 152 for adjusting the flow passing through the valve 324, this assembly 152 being controlled by the servo-control assembly 154.

The control valve 324 is thus pressure-compensated. The regulator 62, and the assembly 152 for adjusting the fluid flow rate delivered to the motor are controlled by the servo-control assembly 154 depending on a hydraulic fluid pressure depending on the load exerted on the motor, measured by the pressure difference at the terminals of the throttle 150 as described earlier.

The thereby obtained device 320 is much more stable depending on the load, which notably allows an increase in the accuracy of the displacement of the lower assembly 34 in the well.

The invention claimed is:

1. A device (20; 220; 320) for intervention in a fluid exploitation well (12), of the type comprising:

a lower assembly (34) bearing at least one intervention and/or measurement tool, intended to be introduced into the well (12);

a cable working line (36) bearing the lower assembly (34);

a winch (38) for maneuvering the line, the winch (38) comprising a rotary drum (42) for winding up the line (36) and a hydraulic central unit (46) for driving the drum (42) into rotation, the hydraulic central unit (46) including:

a tank (50) for storing a hydraulic control fluid;

a pump (52) for driving the hydraulic fluid, the pump being connected to the tank (50) through an upstream conduit (54);

at least one hydraulic motor (56) for driving the drum (42) connected to the pump (52) through an intermediate conduit and connected to the tank (50) through a downstream conduit;

wherein the hydraulic central unit comprises a regulator (62) for the hydraulic fluid flow delivered to said or each hydraulic motor (56), the regulator (62) being controlled according to at least one hydraulic fluid pressure depending on the load exerted on the motor (56) by the rotary drum (42), said or each pressure being directly taken on one of said conduits, and wherein the hydraulic central unit (46) comprises an adjustable calibrated throttle (150), mounted on the intermediate conduit, an upstream tap (158), and a downstream tap (160) for taking the pressure upstream and downstream from the throttle (150), the regulator (62) being servo-controlled for maintaining the pressure difference taken between the upstream and downstream taps (158, 160) to be substantially constant at an adjustable threshold value, wherein the regulator (62) comprises an assembly (152) for adjusting the flow rate of the pump (52) including a mobile member (162) between a minimum flow rate position and a maximum flow rate position, wherein the regulator (62) comprises an assembly (154) for servo-control of the mobile member (162) including a control valve (156) having a slide (184) displaceable between a first control position for the displacement of the mobile member (162) towards the maximum flow rate position and a second control position for the displacement of the mobile member (162) towards the minimum flow rate position, the upstream tap (158) and the downstream tap (160) being hydraulically connected to the control valve (156) for displacing the slide (184) between its control positions depending on the pressure difference between the upstream tap (158) and the downstream tap (160).

2. The device (20; 220) according to claim 1, characterized in that the adjustment assembly (152) comprises an enclosure (164) delimiting a chamber (166) for receiving the mobile member (162), the mobile member (162) defining in the chamber (166) an upstream region (168) hydraulically connected to one of said conduits (96) and a downstream region (170) hydraulically connected to the control valve (156), the slide (184) in its first position being connected to the downstream region (170), for supplying the downstream region with pressurized hydraulic fluid, and in its second position hydraulically connecting the downstream region (170) to a low pressure tank (50).

3. The device (320) according to claim 1, characterized in that it comprises a bypass tubing connecting the outlet of the pump to the tank, the regulator (62) comprising a valve for controlling the flow circulating through the bypass tubing.

4. The device (20; 220; 320) according to claim 1, characterized in that the hydraulic central unit (46) comprises a switching valve (76) displaceable between a first activation position in which the intermediate conduit is formed between the outlet (74) of the pump (52) and a first inlet (100) of the motor (56), and the downstream conduit is formed between a second inlet (102) of the motor (56) and the tank (50), and a second activation position in which the intermediate conduit is formed between the second inlet (102) of the motor and the outlet (74) of the pump (52), and the downstream conduit connects the first inlet (100) of the motor and the tank (50).

5. The device (20; 220; 320) according to claim 4, characterized in that the calibrated throttle (150) comprises a valve with an adjustable orifice (157) placed in the switching valve (76).

6. The device (220) according to claim 1, characterized in that the hydraulic central unit (46) comprises a hydraulically driven member, connected to the pump (52) in parallel on the hydraulic motor (56).

7. An installation (10) for exploiting fluid in the ground (18) characterized in that it comprises:

an exploitation well (12) made in the ground (18), the well (12) opening out in a first point (22) located at the surface (16) of the ground;

a well head (14) obturating the well (12) at the first point (22); and and an intervention device (20; 220; 320) according to claim 1, the lower assembly (34) and the working line (36) being introduced into the well (12) through the well head (14).

8. A method for intervening in a well (12) with a device (20; 220; 320) according to claim 1, characterized in that it comprises the following steps:

mounting the lower assembly (34) on the working line (36) and introducing the lower assembly (34) and the working line (36) into the well (12);

actuating the hydraulic central unit (46) for driving the drum (42) into rotation, the actuation comprising:

applying the pump (52) for driving the hydraulic motor (56) by circulating hydraulic fluid in said conduits, and controlling the flow delivered to said or each hydraulic motor according to at least one pressure depending on the load exerted on the motor (56) by the drum (42), said or each pressure being directly taken on one of said conduits.

* * * * *